United States Patent [19]

Tanner et al.

[11] Patent Number: 4,490,777

[45] Date of Patent: Dec. 25, 1984

[54] SELECTIVE COLOR ILLUMINATION DEVICE FOR ELECTRONIC DRAFTING TABLES

[76] Inventors: Stephen E. Tanner; Eugene J. Tanner, both of 17 Oak Tree Dr., Smithtown, N.Y. 11787

[21] Appl. No.: 277,179

[22] Filed: Jun. 25, 1981

[51] Int. Cl.[3] ..... F21S 3/00

[52] U.S. Cl. ..... 362/221; 362/33; 362/217; 362/222; 362/223; 362/225; 362/231; 362/251; 362/295; 362/311; 362/375

[58] Field of Search ..... 362/33, 217, 221, 222, 362/223, 225, 231, 251, 295, 311, 375; D6/156

[56] References Cited

U.S. PATENT DOCUMENTS

| | | | |
|---|---|---|---|
| 2,643,326 | 6/1953 | Knapp | 362/225 X |
| 2,725,461 | 11/1955 | Amour | 362/231 |
| 4,064,430 | 12/1977 | Owens | 362/231 |

*Primary Examiner*—Stephen J. Lechert, Jr.

[57] ABSTRACT

A multiple light device for the illumination of bicolored translucent self adhesive tape drawings, principally used in electronic circuit drafting, which through the principal of selective absorption highlights the contrast and or color difference between the two tapes. The device is designed to replace the fluorescent lamps in light tables used in viewing the drawings without any modifications necessary to the table or lamp sockets and provides a means of illuminating the table surface with a manually selected limited spectrum light or an approximated white light by moving a magnetic field generating device, typically a magnet, over the top surface of the table on the underside of which is affixed, by adhesive, three magnetic field sensing devices forming an electrical circuit between the original lamp socket in the table and one of the three new lamp sockets supported by radially and laterally adjustable support members connected to the main support member, which includes pin contacts at each end and is of a size and configuration so as to easily fit in the original fluorescent lamp socket in the table with said contacts being attached to wires emerging from the center of the tubular main support member, connected to the switching devices and to the new lamp sockets of this device.

1 Claim, 3 Drawing Figures

SELECTIVE COLOR ILLUMINATION DEVICE FOR ELECTRONIC DRAFTING TABLES

BACKGROUND OF THE INVENTION

The present invention relates to selective color illumination of drafting tables and in particular to light tables used for the making of electronic drawings.

SUMMARY OF THE INVENTION

The object of the present invention is to provide a new and improved source of illumination and to provide a means of differentiating between various colors used in precision-slit, pressure sensitive, printed circuit artwork tapes and patterns used in drafting of electronic circuits layout designs. Differentiating between two colored translucent drafting tapes is achieved by illuminating said tapes with a color light similar to one of the tape colors producing a background from which a like color translucent tape will be indistinguishable and a translucent tape of substantially different color will be clearly distinguishable, due to the physical concept of selective absorption. This method can be used with many color combinations. The most pronounced effect occurs using primary colors. A still further object is to provide a light fixture of the character described which maybe manufactured from relatively inexpensive durable materials and which can be installed in an existing drafting table without electrical or mechanical modification to said table.

The invention possesses other objects and features of advantage some of which of the foregoing will be set forth in the following description of the preferred form of the invention which is illustrated in the drawings accompanying and forming part of this specification. It is to be understood, however, that variations in the showing made by said drawings and description maybe adopted within the scope of the invention as set forth in the claims.

BRIEF DESCRIPTION OF THE DRAWINGS

With reference to said drawings (2 SHEETS)

Figure 1:
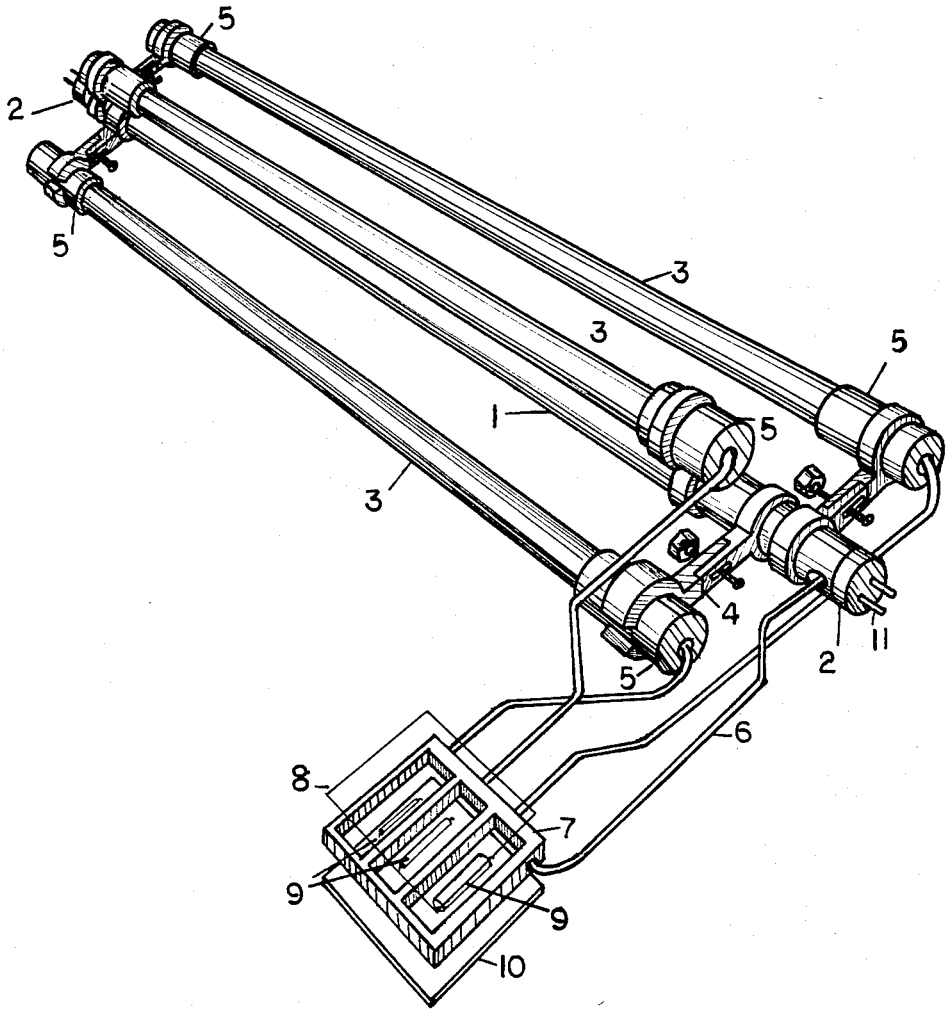
FIG. 1 is a perspective view of the device as constructed in accordance with the preferred embodiment of the present invention.
Figure 2:
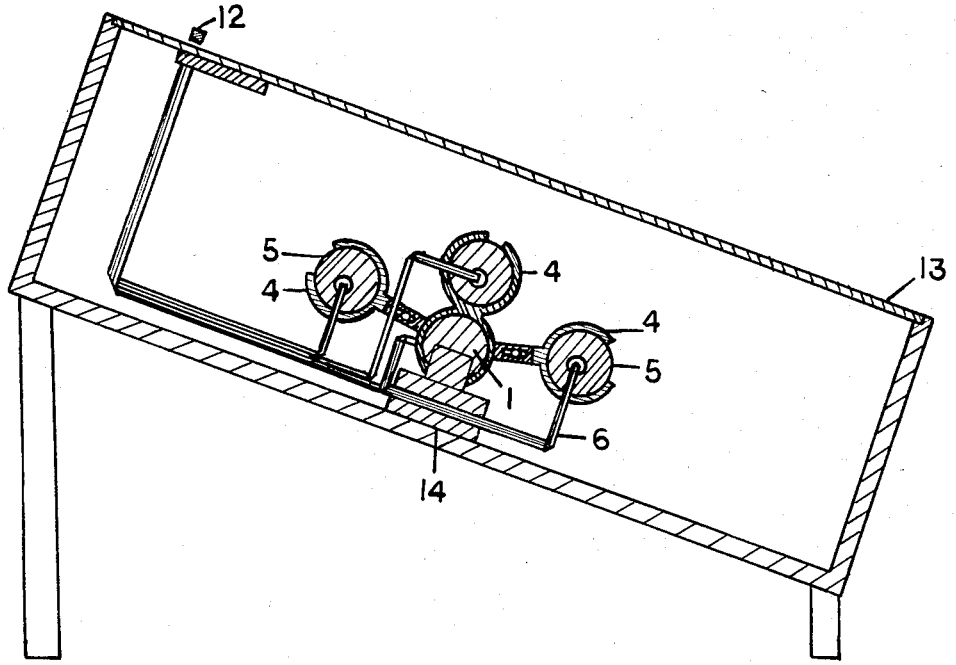
FIG. 2 is an enlarged cross section of the device installed in the original lamp fixture in a typical light table.

Referring to the device as shown in FIGS. 1, and 2, the light fixture consists briefly of a rigid plastic tube 1 used to replace the fluorescent lamp currently used in illuminated drafting tables. The size of the tube and end caps 2, with electrical contact pins 11, are of a size and position to allow ready interchangeability of the rigid main support tube 1 with a fluorescent lamp. The tube also serves as the base to support three fluorescent lamps 3 by means of adjustable, movable, connecting arms 4 affixed to both the rigid tube 1 and simultaneously to each of the fluorescent lampsocket holders 5. The fluorescent lamps 3 consist of one each of the colors white, red and blue to be selectively illuminated in order to provide a differentiation between red and blue translucent self adhesive tape electronic drawing designs affixed to a clear mylar support sheet suspended on a translucent and or transparent drafting surface 13 directly above and adjacent to the light fixtures. Further, the light fixture and individual selectivity of flourescent color lamps 3 is obtained through the use of a series of twelve reed switches 9 mounted, with electrical contact pins 11, in a plastic holder FIG. 3 and affixed to the underside of the drafting table drawing surface FIG. 2 which maybe constructed of glass, plexiglass or other rigid translucent or transparent material. The switch assembly is bonded to the underside of the drafting surface made using an adhesive or adhesive tape 8. The switch assembly 7 is connected to the the lampsocket holders 5 and endcaps 2 by multilead wire cable 6.

Selectability of red, white and blue colors is accomplished through the use of a magnet 12 placed directly on the drawing surface over the reed switch assembly FIG. 7 and moving the magnet to a section of the assembly controlling the particular color light required to highlight a specific color drafting tape. By placing the magnet 12 over the reed switch 9, the switch assumes a closed position (normally open) and allows the flow of electricity from the endcap 2 to the lampsocket holders 5 of the desired color lamp 3. The reed switch will remain closed until another color is chosen and the magnet moved to the position of the switchbox representing the selected color.

In constructing drafting tables of various sizes, one or more light fixtures FIG. 2 having a single lamp or a plurality of lamps may be used.

Drafting tables currently incorporate fixtures using white fluorescent lamps to illuminate the drafting surface thereby providing no means of differentiating between red and blue drafting tapes used to form the electronic design pattern. The invention allows an easy substitution for the present lamps in their fixture with no electrical or mechanical changes to the light fixture or drafting table.

We claim:

1. A multiple light device comprised of, a main support tubular member or rod having contact pins at each end with electrical wires connected to said pins and emerging from the center of said member which is of a length similar to standard fluorescent lamps, support members both laterally and radially adjustable affixed to both the main support member and lamp sockets/fixtures by friction fit or adhesive, a switching device connected to the main support contact pins and the lamp sockets via electrical wires comprised of a plastic enclosure with a self adhesive outer/upper surface, enclosing multiple sets of equally spaced magnetic field sensing devices (reed switches or hall effect devices) with only one device or set of devices actuated at any given time completing the electrical circuit from the main support member contact pins to one of the lamp sockets by manual random hand placement of a magnet over one or one set of said field sensors, and multiple light emitting devices principally of fluorescent lamp type supported by and electrically connected to the lamp sockets wherein two of the lamps each produce a different light emission spectrum or are enclosed in a material having predominantly different optical transmission spectrums and the third lamp produces a broad spectral emission typically known as "white light".

* * * * *